US005618201A

United States Patent [19]

Yagi et al.

[11] Patent Number: 5,618,201

[45] Date of Patent: Apr. 8, 1997

[54] CONNECTOR HAVING ENGAGEMENT DETECTING DEVICE

[75] Inventors: Sakai Yagi; Masanori Tsuji; Keishi Jinno, all of Shizuoka-ken; Takahiro Yoneda, Isehara, all of Japan

[73] Assignees: Yazaki Corporation, Tokyo; Nissan Motor Co., Ltd., Yokohama, both of Japan

[21] Appl. No.: 429,881

[22] Filed: Apr. 27, 1995

[30] Foreign Application Priority Data

Jun. 14, 1994 [JP] Japan ..... 6-131765

[51] Int. Cl.[6] ..... H01R 3/00

[52] U.S. Cl. ..... 439/489; 439/188

[58] Field of Search ..... 439/188, 488, 439/489, 350, 357, 352, 507, 509; 200/51.09, 51.1

[56] References Cited

U.S. PATENT DOCUMENTS

| | | | |
|---|---|---|---|
| 5,174,786 | 12/1992 | Kato et al. | 439/489 |
| 5,370,543 | 12/1994 | Hamada et al. | 439/489 |
| 5,391,087 | 2/1995 | Fukuda | 439/489 |

FOREIGN PATENT DOCUMENTS

| | | |
|---|---|---|
| 3-32377 | 3/1991 | Japan . |
| 3-285280 | 12/1991 | Japan . |

*Primary Examiner*—Hien Vu

*Attorney, Agent, or Firm*—Oblon, Spivak, McClelland, Maier & Neustadt, P.C.

[57] ABSTRACT

A connector having an engagement detecting device, comprises: a first connector housing for housing a plurality of first connector terminals; a second connector housing for housing a plurality of second connector terminals mated with the first connector terminals, and engaged with the first connector housing; a slider inserted into the first connector housing in two stages of a half engagement position and a full engagement position; and a short-circuit spring disposed within the first connector housing, for shorting electrically two adjacent mated connector terminals when the slider is inserted into the first connector housing to the half engagement position, but disconnecting electrically the same two adjacent mated connector terminals when the second connector housing is engaged with the first connector housing and thereafter the slider is further inserted into the first connector housing to the full engagement position. The short-circuit spring can apply a reaction force to the slider when the slider is further inserted to the full engagement position, thus providing a stable connector engagement detecting device while decreasing the number of parts.

8 Claims, 15 Drawing Sheets

CONNECTOR HAVING ENGAGEMENT DETECTING DEVICE

BACKGROUND OF THE INVENTION

1. Technical Field

The present invention relates to a connector having a engagement detecting device, and more specifically to a connector provided with a function for detecting whether two connector housings have been engaged perfectly. The connector having an engagement detecting device of this sort is suitable in use as an important connector for an automotive vehicle.

2. Description of the Prior Art

In the case of a connector used for a wiring system of an air bag apparatus of an automotive vehicle, it is necessary to severely check whether male and female connector housings have been engaged with each other perfectly.

Japanese Published Unexamined (Kokai) Patent Application No. 3-285280 discloses a connector having a mechanical connector housing engagement detecting device. This connector is roughly composed of a female connector, a male connector, and a slider.

In use, the slider is first inserted into the male connector housing; the male connector housing is engaged with the female connector housing to connect male terminals with female terminals. Under these conditions, when the slider is further inserted into the male connector housing, the slider can be located at a lock confirm position. In other words, only after the male and female connector housings have been locked perfectly, since the slider can be moved to the lock confirm position, it is possible to check whether the male and female connector housings have been engaged perfectly on the basis of the movement condition of the slider.

In this conventional connector having a mechanical engagement detecting device, however, since the slider is stopped only a single stopper and further a lock detection arm is located outside, in case an external force is applied to the lock detection arm, the slider is easily moved, irrespective of the connector housing engagement condition, so that there exists a problem in that the connector housing engagement condition cannot be detected stably.

In addition, in this conventional connector, in spite of the fact that the connector housing engagement is detected on the basis of the position of the slider, there exists a problem in that when the slider is left pushed midway without being pushed deep perfectly, it is impossible to check whether the connector housings have been engaged perfectly from the outside.

On the other hand, Japanese Published Unexamined (Kokai) Patent Application No. 3-32377 discloses a connector having an electrical engagement detecting device. This connector is roughly composed of a female connector housing, a male connector housing, a slider, a coil spring, a V-shaped terminal shorting spring, and a rear holder.

In use, the slider is first inserted into the male connector housing. Under these conditions, the V-shaped terminal shorting spring is left open outward to short a pair of two male terminals housed in the male connector housing therethrough. Further, after the male connector housing is engaged with the female connector housing to connect male terminals with female terminals, the slider is further inserted into the female connector housing. In this case, since the V-shaped terminal shorting spring is kept closed inward and thereby the two male terminals are disconnected from the V-shaped terminal shorting spring, the two mated terminals are released from the shorted state. By electrically checking this release of the shorted state, it is possible to detect whether the male and female connector housings have been engaged with each other perfectly.

In this conventional connector having an electrical engagement detecting device, however, since the V-shaped terminal shorting spring is attached to the slider and thereby moved together with the slider, it is difficult to stably support the terminal shorting spring, so that there exists a problem in that the terminal shorting spring is easily dislocated and thereby,the reliability of the electrical detection deteriorates. In addition, there exists another shortcoming that the structure of the connector is complicated and therefore the manufacturing cost thereof is relatively high.

SUMMARY OF THE INVENTION

With these problems in mind, therefore, it is the object of the present invention to provide a connector having an engagement detecting device, by which the engagement conditions of male and female connector housings can be detected reliably, without increasing the number of parts and the manufacturing cost thereof.

To achieve the above-mentioned object, the present invention provides a connector having an engagement detecting device, comprising: a first connector housing (100) for housing a plurality of first connector terminals (23); a second connector housing (200) for housing a plurality of second connector terminals (21) mated with the first connector terminals, and engaged with said first connector housing; a slider (300, 300A) inserted into said first connector housing in two stages of a half engagement position and a full engagement position; and a short-circuit spring (400) disposed within said first connector housing, for shorting electrically two adjacent mated connector terminals (23, 21) when said slider is inserted into said first connector housing to the half engagement position, but disconnecting electrically the same two adjacent mated connector terminals when said second connector housing (200) is engaged with said first connector housing (100) and thereafter said slider is further inserted into said first connector housing from the half engagement position to the full engagement position.

Here, the short-circuit spring (400) is formed into a U-shape having a pair of elastic arms (404), each of the elastic arms (404) being formed with a V-shaped contact piece (410, 412) at each free end thereof in such a way as to be connected to or disconnected from the mated connector terminals and further as to apply a reaction force from the V-shaped contact piece to said slider when said slider is being further inserted into said first connector housing from the half engagement position to the full engagement position.

Further, the slider (300) is formed with at least one bendable arm (340, 320) stopped by said first connector housing in the half engagement position, a pair of disconnect arms (310) for disconnecting electrically the V-shaped contact pieces (410) of said short-circuit spring (400) from the mated connector terminals (23, 21) respectively, and a full engage portion (352). Further, each of the disconnect arms (310) is formed with a sloped surface (312) at a free end thereof to apply the reaction force effectively from the V-shaped contact piece (410) of said short-circuit spring (400) to said slider (300), when said slider is further inserted into said first connector housing from the half engagement position to the full engagement position.

Further, the first connector housing (100) is formed with a movable lock/stop arm (112) and at least one slider stopper (150) to stop said slider inserted into said first connector housing (100) to the half engagement position. The second connector housing (200) is formed with a slider release portion (210) for moving the movable lock/stop arm (112) and a slider release projection (206) for moving the bendable arm (320) of said slider, to allow said slider from the half engagement position to the full engagement position after said second connector housing (200) is engaged with said first connector housing (100).

Further, the first connector housing (100) is formed with a movable full engage projection (114) engaged with the full engage portion (352) of said slider when said slider is inserted into said first connector housing (100) to the full engagement position.

Further, the first connector housing (100) is formed with a pair of guide grooves (134) for guiding a pair of the disconnect arms (310).

As described above, in the connector according to the present invention, since the half engagement of the male and female connector housings can be detected electrically, the connector assembly process can be automatized. Further, at the full engagement position, since the terminals are not shorted, it is possible to check the connector housing engagement conditions by use of the wires actually connected to the terminals (without additionally connecting any other detecting wires).

Further, since the short-circuit spring is disposed statically (without being moved together with the slider) within the male connector housing under well balanced condition, the short-circuit spring can be connected to or disconnected from the female connector terminals more stably, thus providing for a more reliable connector housing engagement detection.

Further, when the slider is inserted to the full engagement position, since a reaction force is applied from the short-circuit spring to the slider, a secure feeling can be obtained and further the slider will not be stopped midway (because returned to the original position), so that it is possible to prevent the slider from being moved inadvertently in spite of the fact that no other spring is not used.

Further, since the sloped surface is formed at the free end of each of the disconnect arms of the slider, it is possible to apply a reaction force from the short-circuit spring to the slider more effectively and stably, and further a click feeling to the worker at the full engagement position.

DETAILED DESCRIPTION OF THE EMBODIMENTS

Embodiments of the connector having an engagement detecting device according to the present invention will be described hereinbelow with reference to the attached drawings.

Figure 1:
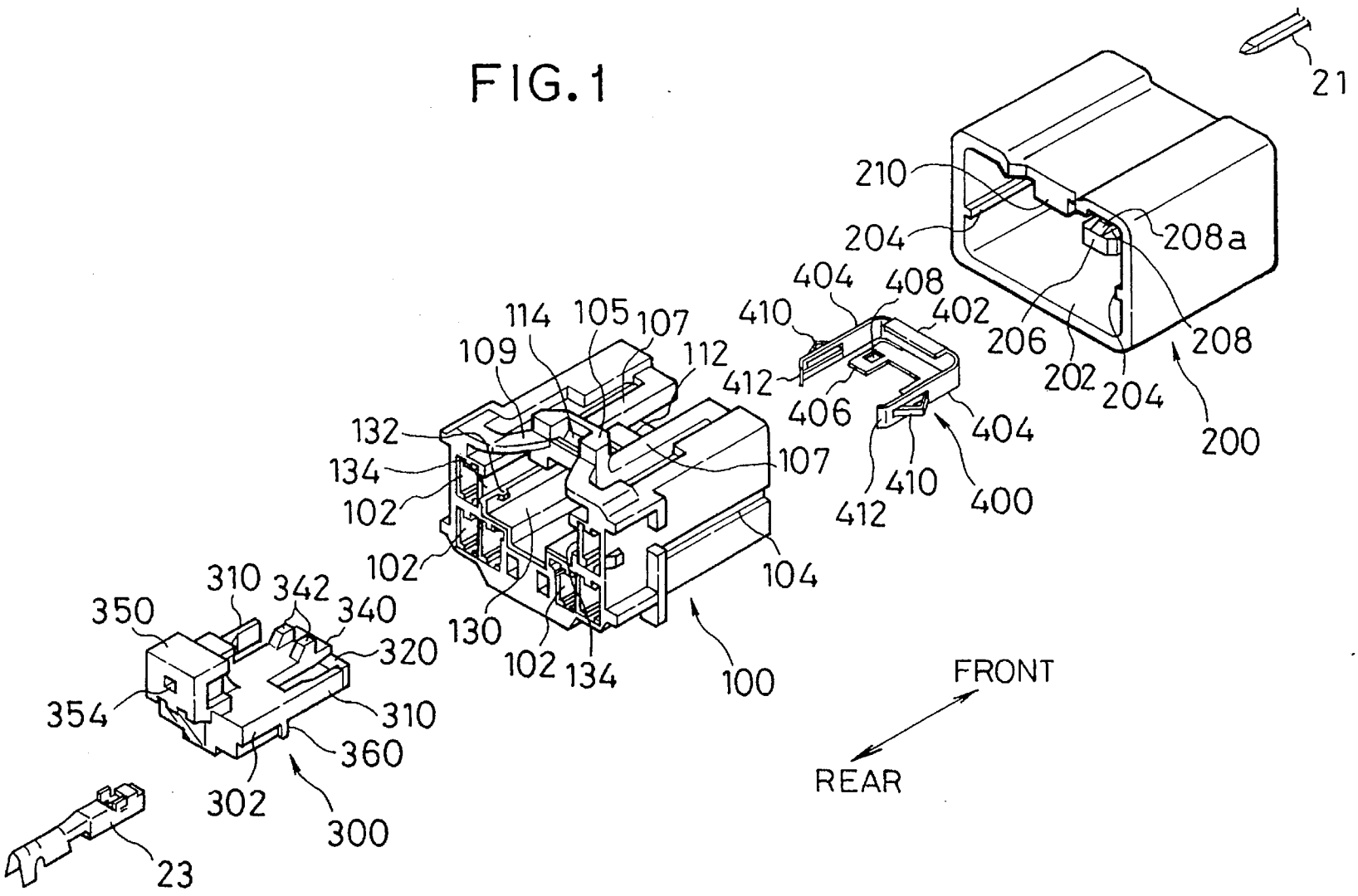
FIG. 1 is an exploded view showing an entire structure of a first embodiment of the connector having an engagement detecting device according to the present invention.

FIG. 1 is an exploded view showing the first embodiment thereof. The connector is roughly composed of a male connector housing 100, a female connector housing 200, a slider 300 slidably inserted into the male connector housing 100, and a short-circuit spring 400. Further, a plurality of female terminals 23 are housed in terminal insertion holes 102 of the male connector housing 100, and a plurality of male terminals 21 are housed in terminal insertion holes (not shown) of the female connector housing 200.

As shown in FIG. 1, the male connector housing 100 is formed with a slider housing chamber 130 for housing the slider 300 at the middle rear (the left side in FIG. 1) end side thereof. A plurality of the terminal insertion holes 102 are formed on the outside of the slider housing chamber 130 in the male connector housing 100.

Figure 2A:
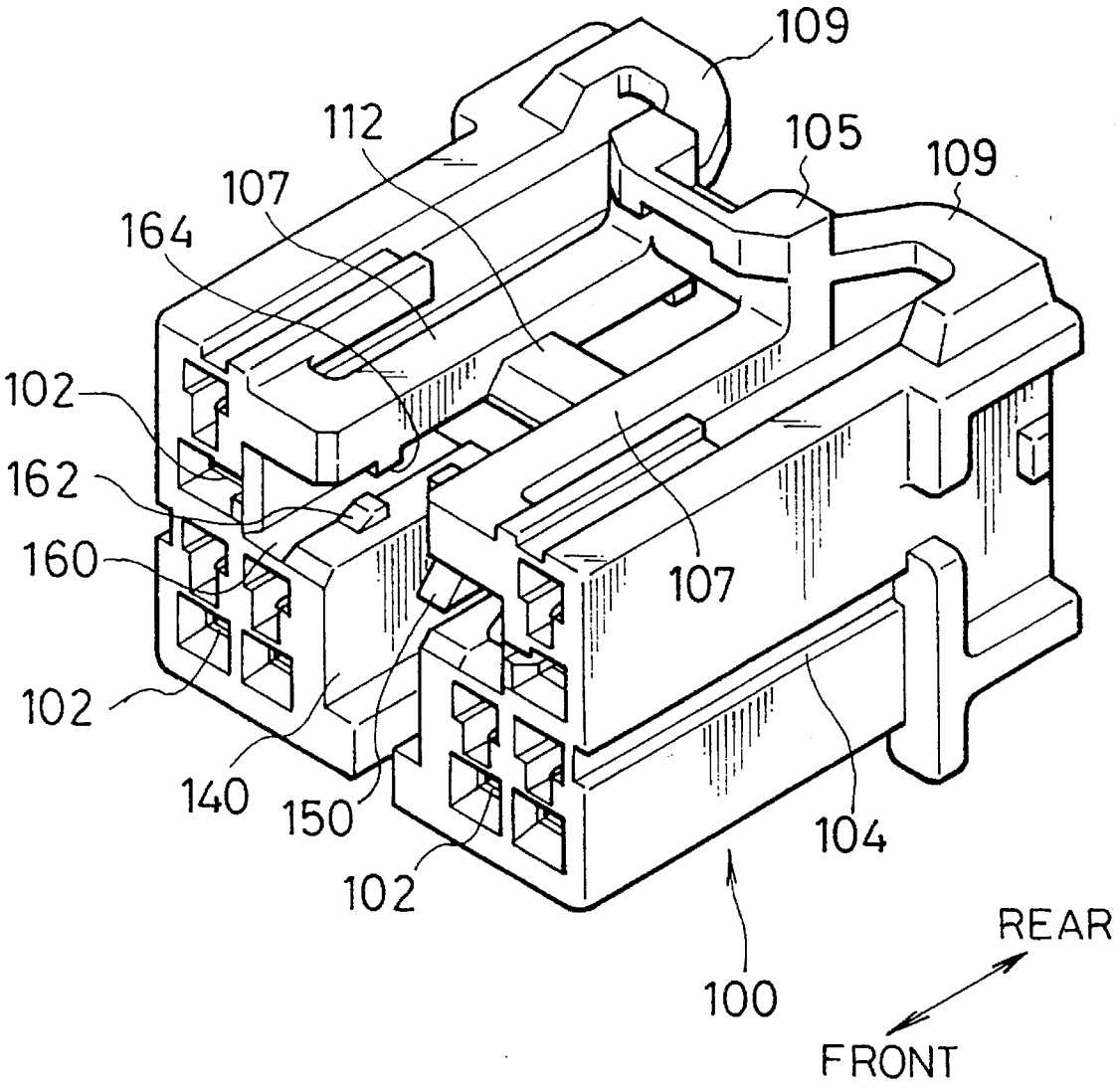
FIG. 2A is a perspective view showing the male connector housing of the first embodiment of the present invention, obtained when seen from the front side thereof.
Figure 2B:
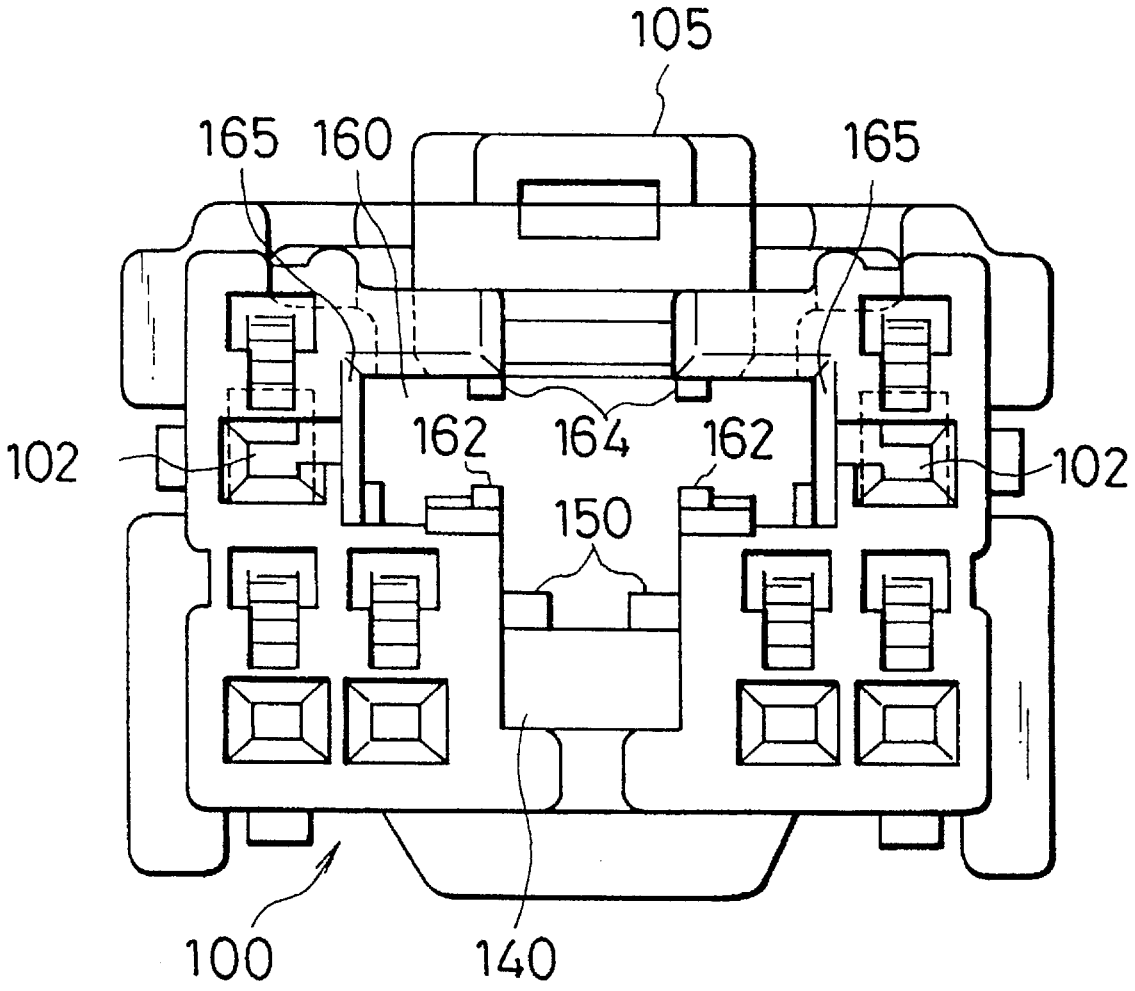
FIG. 2B is a front view showing the same male connector housing of the first embodiment of the present invention.
Figure 3:
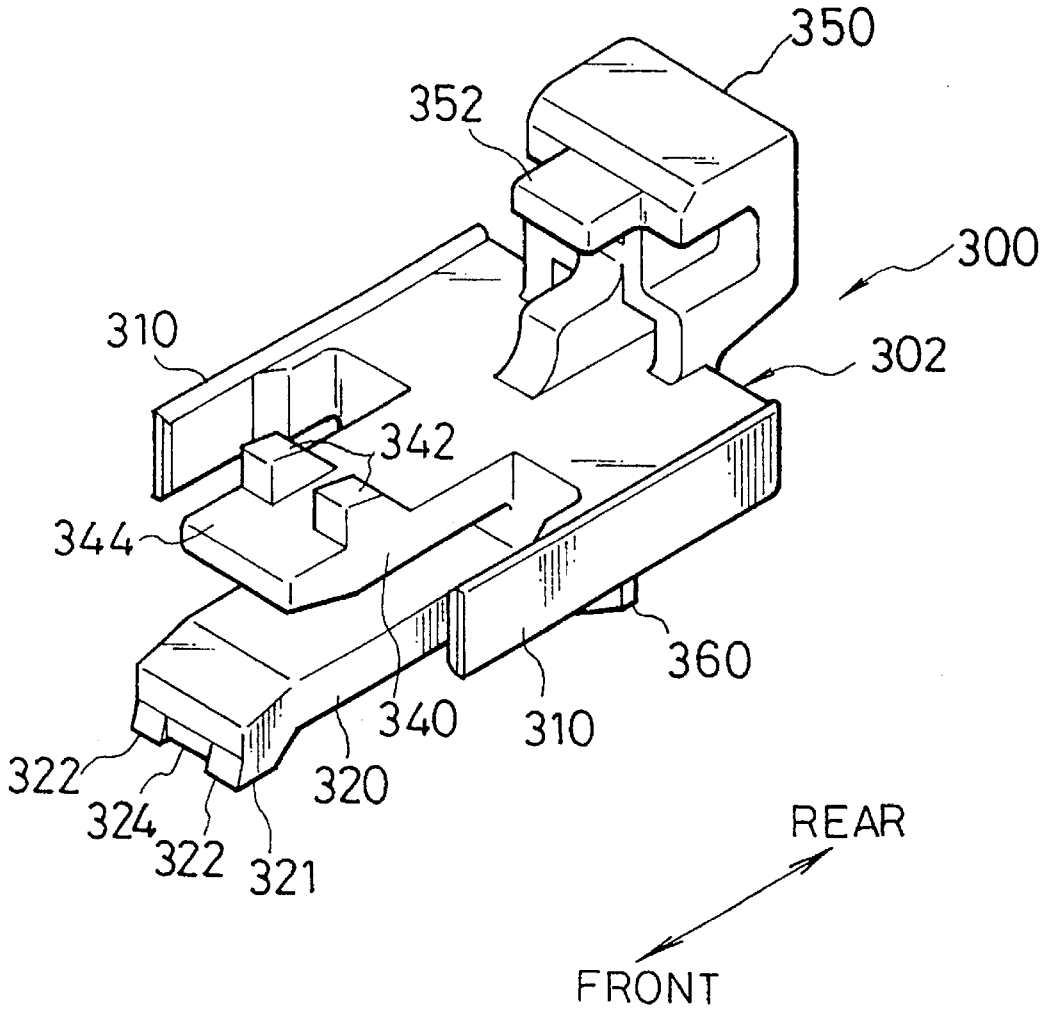
FIG. 3 is a perspective view showing the slider of the first embodiment of the present invention.

FIGS. 2A–2B and 3 show the front side of the male connector housing 100 when seen from the right side in FIG. 1, in which terminal insertion holes 102 are opened. Further, each terminal insertion hole 102 for the female connector terminal 23 communicates with each terminal inserting hole 200 for the male connector terminal 21.

On two outer side surfaces of the male connector housing 100, guide grooves 104 are formed, respectively. On the upper surface of the male connector housing 100, a bendable lock arm 105 is formed. The bendable lock arm 105 is formed with two parallel arranged long arm portions 107 extending in the front direction and two side short arm portions 109 extending in both the sides thereof in such a way that four fixed ends of the four arms 107 and 109 are formed integral with the outer wall of the male connector housing 100, as shown in FIG. 2A. Further, a movable lock/stop arm 112 is formed between the two long arm portions 107 so as to be locked with the female connector housing 200. This movable lock/stop arm 112 is used.

Further, as shown in FIG. 1, a movable full engage projection 114 engaged with the slider 300 is formed at a joined portion at which four free ends of the arm portions 107 and 109 are joined with each other. Further, a half engage projection 132 engaged with the slider 300 inserted to a half engage position is formed on both the side walls of the slider housing chamber 130, respectively. Further, two guide grooves 134 for guiding the slider 300 in the front and rear direction are formed above the half engage projections 132 and on both the side walls of the slider housing chamber 130, respectively.

As shown in FIGS. 2A and 2B, on the front end sides of the male connector housing 100, a slider release projection (206) housing groove 140 and short-circuit spring (400) housing chambers 160 are formed in such a way that the slider release projection housing groove 140 is located below the two short-circuit spring housing chambers 160. Further, a pair of slider stoppers 150 are formed on both side walls of the slider release projection housing groove 140. Between the two slider stoppers 150, a guide projection 208 of a slider release projection 206 of the female connector housing 200 is inserted. Further, a short-circuit spring engage projection 162 is formed on both sides of the lower surface of the short-circuit spring housing chamber 160, respectively; and a locating projection 164 is formed on both sides of the upper surface of the short-circuit spring housing chamber 160, respectively.

As shown in FIGS. 1 and 3, the slider 300 is formed with a first bendable arm 340 and a second bendable arm 320 both extending from the front end of a body portion 302 thereof roughly in parallel to each other. Further, a pair of thin plate-shaped disconnect arms 310 also formed so as to extend in the front direction on both sides of the front end of the body portion 302. Further, a half engage projection 360 engaged with the half engage projection 132 formed in the slider housing chamber 130 is formed on both sides of the lower surface of the body portion 302, respectively. Further, a handling portion 350 is formed on the upper surface of the body portion 302. The handling portion 350 is formed with a full engage portion 352 engaged with the movable full engage projection 114 formed in the bendable lock arm 105 of the male connector housing 100. This handling portion 350 is used to easily remove the full engage portion 352 from a molding die.

On the upper surface of the first bendable arm 340 of the slider 300, a pair of engage projections 342 engaged with the movable lock/stop arm 112 of the male connector housing 100 are formed. On the front side of these two engage projections 342, a support wall 344 is formed. Further, on the lower surface of the free end of the second bendable arm 320, an engage projection 321 is formed. On both side of the end of this engage projection 321, two collide walls 322 brought into collision with the slider stoppers 150 of the male connector housing 100 are formed. A guide slope surface 324 is formed between the two collide walls 322. The disconnect arms 310 are slidably inserted into the guide grooves 134 formed on both sides of the inner side walls of the short-circuit housing chamber 160.

As shown in FIG. 1, the short-circuit spring 400 is formed by bending an elastic steel plate into a U-shape. That is, a pair of elastic arms 404 extend from both sides of a base plate portion 402 toward the male connector housing 100. Further, a pair of upper and lower plates 402 and 406 are formed on both vertical end sides of the base plate portion 402. On both sides of the lower plate 406, two engage holes 408 are formed so as to be engaged with the short-circuit engage projections 162 (shown in FIG. 2B) formed in the short-circuit spring housing chamber 160 of the male connector housing 100.

On the outer side of each of the elastic arms 404, an externally bent V-shaped contact piece 410 is formed. When the disconnect arms 310 of the slider 300 are brought into contact with the V-shaped contact pieces 410, respectively, the elastic arms 404 are deformed effectively.

Figure 4A:
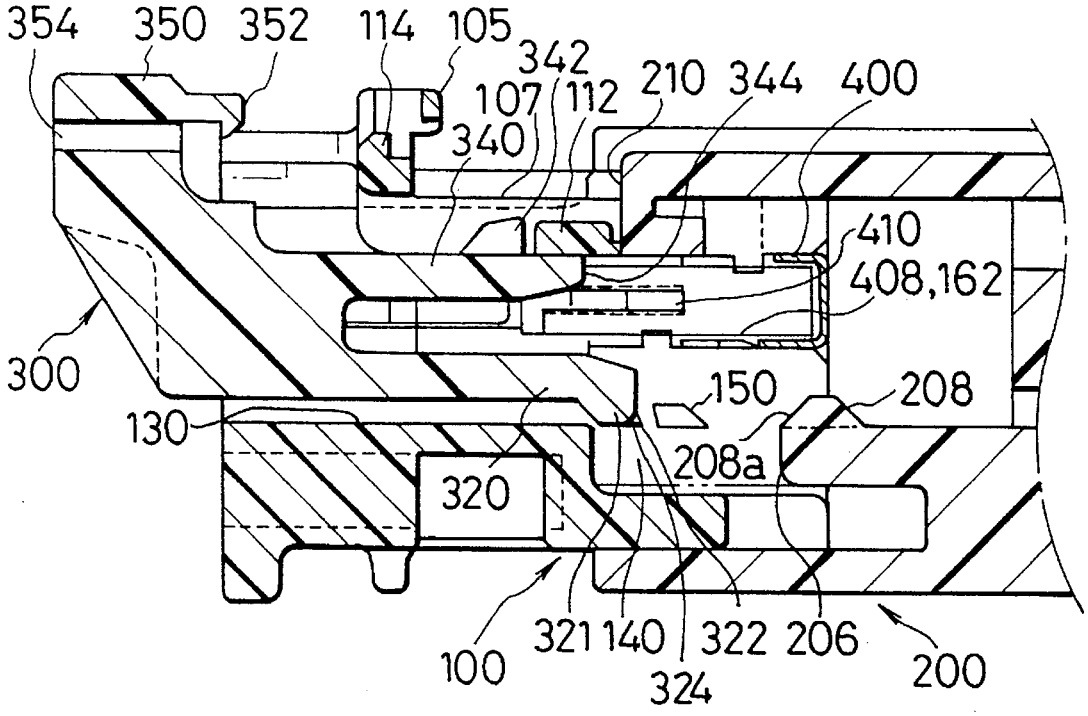
FIG. 4A is a longitudinal cross-sectional view showing the connector of the first embodiment at a half engagement position.
Figure 4B:
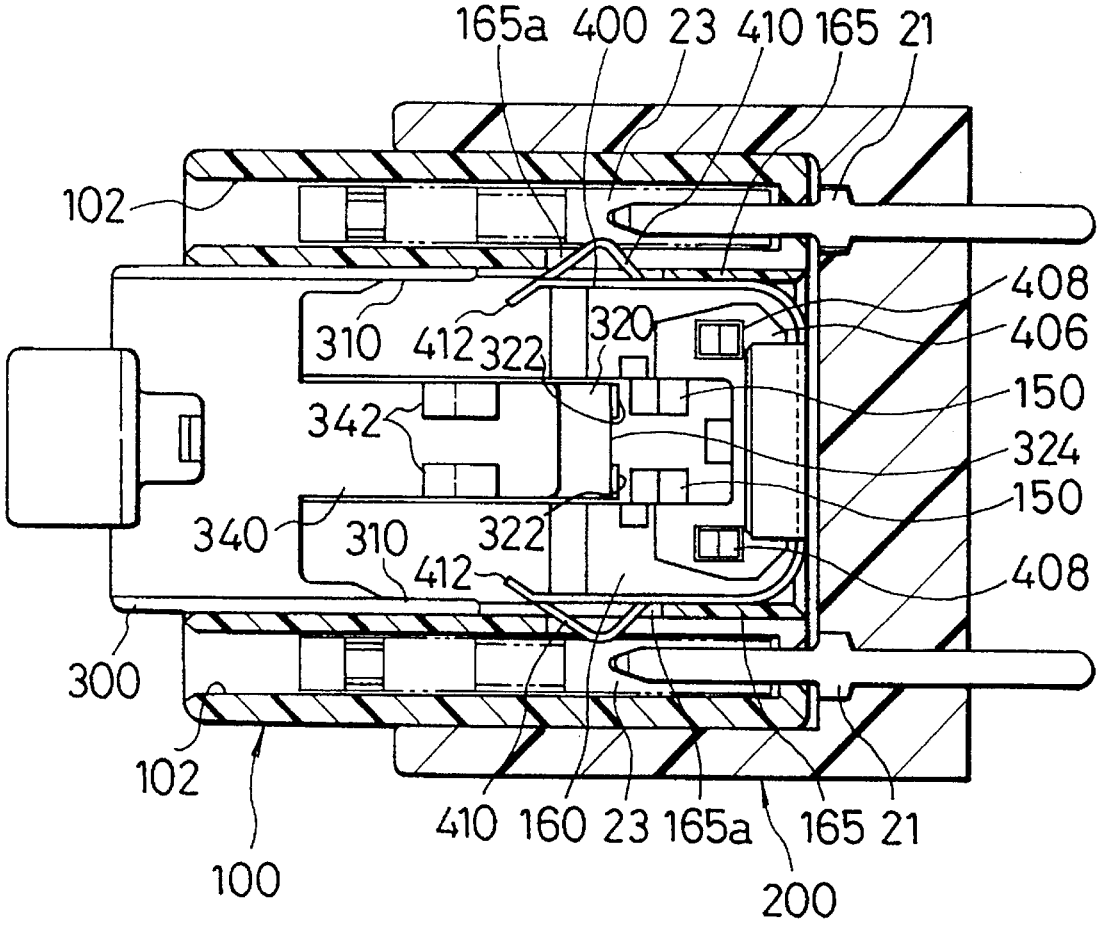
FIG. 4B is a transverse cross-sectional view showing the same connector of the first embodiment at the half engagement position.

FIGS. 4A and 4B show the assembled status of the male connector housing 100, the female connector housing 200, the slider 300 and the short-circuit spring 400 (at a half engagement position). On both sides of the short-circuit spring housing chamber 160 of the male connector housing 100, two terminal insertion holes 102 are formed by two partition walls 165. Further, a slit 165*a* is formed in each partition wall 165. Therefore, when the short-circuit spring 400 is inserted into the male connector housing 100, the V-shaped contact pieces 410 are engaged with the slits 165*a* formed in two partition walls 165 of the male connector housing 100, as shown in FIG. 4B, so that the short-circuit spring 400 can be supported stably therein. Further, on the free ends of the elastic arms 404 of the short-circuit spring 400, a guide plate portion 412 bent inwardly is formed, respectively. These guide plate portions 412 are also elastically deformed inward.

On the other hand, the female connector housing 200 is formed with a male connector housing chamber 202. 0n both right and left inner walls of the male connector housing chamber 202, a guide projection 204 slidable along the guide groove 104 of the male connector housing 100 is formed, respectively. Further, the slider release projection 206 is formed at the middle portion of the inner wall of the female connector housing 200, as shown in FIG. 4A. This slider release projection 206 is inserted into the release projection housing groove 140 formed in the male connector housing 100.

Figure 5:
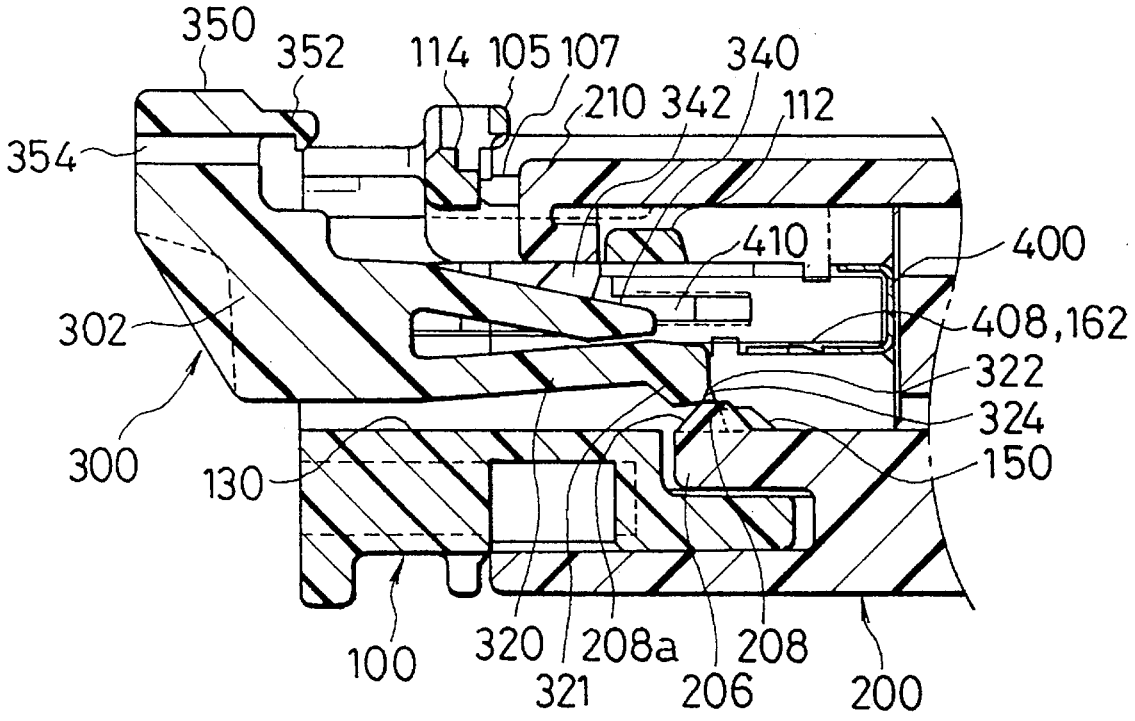
FIG. 5 is a longitudinal cross-sectional view showing the same connector of the first embodiment, in which the female connector housing is engaged with the male connector housing.

This slider release projection 206 is formed with a guide projection 208 having a guide surface 208*a*. When the slider 300 is inserted into the male connector housing 100 and further the female connector housing 200 is engaged with the male connector housing 100, since the guide surface 208*a* of the slider release projection 206 is brought into contact with the guide surface 324 formed at the fee end of the second bendable arm 320 of the slider 300, the second bendable arm 320 can be deformed as shown in FIG. 5 so as to override the slider stoppers 150 formed in the male connector housing 100. The guide projection 208 can be inserted between the two slider stoppers 150.

Further, on the inner surface of the upper wall of the male connector housing chamber 202 of the female connector housing 200, a slider release portion 210 is formed so as to be engaged with the movable lock/stop arm 112 of the bendable lock arm 105 of the male connector housing 100.

Figure 6A:
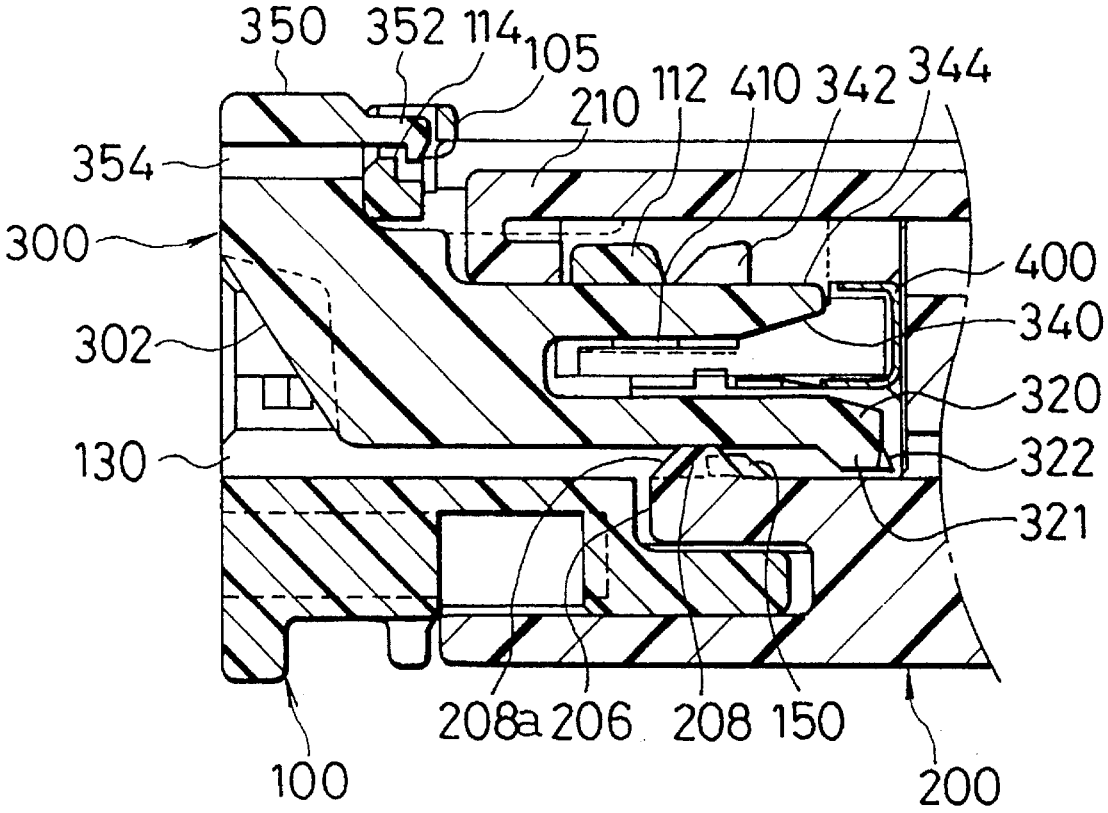
FIG. 6A is a longitudinal cross-sectional view showing the connector of the first embodiment at a full engagement position.
Figure 6B:
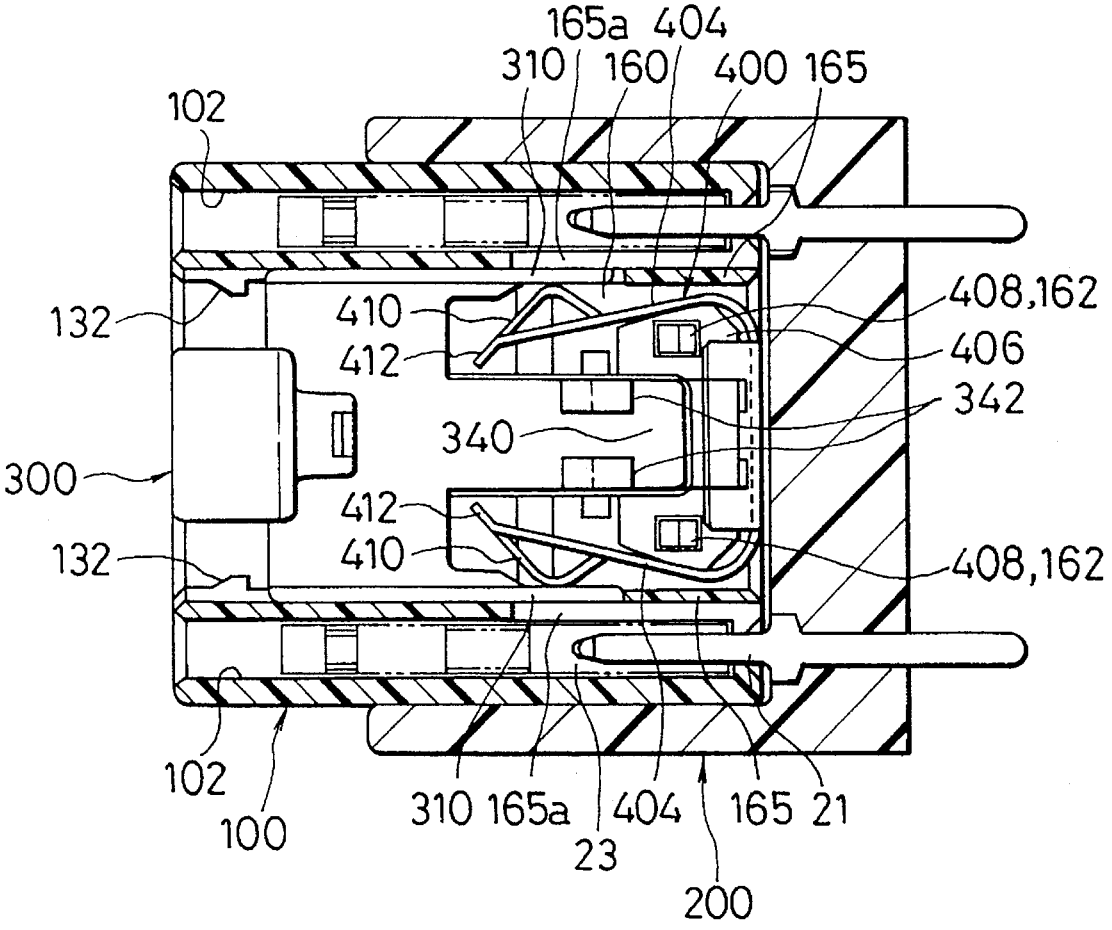
FIG. 6B is a transverse cross-sectional view showing the same connector of the first embodiment at the half engagement position.

The function of the connector as described above will be explained hereinbelow in detail. First, the engagement procedure will be summarized as follows: (1) the short-circuit spring 400 is disposed within the male connector housing 100 to short the two adjacent female connector terminals 23, as shown in FIGS. 4A and 4B; (2) the slider 300 is inserted into the male connector housing 100 to a half engagement position, also as shown in FIGS. 4A and 4B; (3) the female connector housing 200 is engaged with the male connector housing 100, as shown in FIG. 5; and (4) the slider 300 is further inserted into the male connector housing 100 to a full engagement position to disconnect the short-circuit spring 400 from the two adjacent female connector terminals 23, as shown in FIGS. 6A and 6B.

The above-mentioned engagement procedure will be described in further detail hereinbelow.

(1) As shown in FIGS. 4A and 4B, the short-circuit spring 400 is inserted into and disposed in the short-circuit spring housing chamber 160 (See FIG. 2A). Under these conditions, since the V-shaped contact pieces 410 of the short-circuit spring 400 are engaged with the slits 165*a* of the partition walls 165 of the male connector housing 100 and project into the terminal insertion holes 102 formed on both sides of the short-circuit housing chamber 160, the short-circuit spring 400 is brought into contact with the female terminals 23 to short them.

(2) As shown in FIGS. 4A and 4B, the slider 300 is inserted into the male connector housing 200 by fitting the two (both sides) disconnect arms 310 to the guide grooves 134 of the male connector housing 100. In this case, when inserted to a half engagement position, the slider 300 is stopped, because the half engage projections 360 of the slider 300 are brought into contact with the half engage projections 132 of the male connector housing 100 (See FIG. 1). During this insertion of the slider 300, since the disconnect arms 310 can be guided by the guide grooves 134, the slider 300 can be securely and stably inserted into the male connector housing 100 without any inclination. At the half engagement position, the engage projections 342 of the first bendable arm 340 of the slider 300 are in contact with the movable lock/stop arm 112 of the male connector housing 100. In the same way, the collide walls 322 of the engage projection 321 of the second bendable arm 320 of the slider 300 are in contact with the slider stoppers 150 of the male connector housing 100 (See FIG. 2A), so that the slider 300 cannot be further inserted from the half engagement position. In the above-mentioned engagement, since the two disconnect arms 310 are fitted to the two guide grooves 134 of the male connector housing, the slider 300 can be supported stably. Further, the slider 300 is kept stopped by the first and second bendable arms 340 and 320 at four different points of the engage projections 342 and 321, even if any force is applied to the slider 300, it is possible to prevent the slider 300 from being further inserted into the male connector housing 100 to the full engagement position erroneously.

(3) As shown in FIG. 5, the female connector housing 200 is engaged with the male connector housing 200. Here, since the slider release portion 210 of the female connector housing 200 overrides the movable lock/stop arm 112 of the bendable lock arm 105 of the male connector housing 100 and engaged with the same movable lock/stop arm 112, the two male and female connector housings 100 and 200 can be engaged with each other, so that the male connector terminals 21 can be connected to the female connector terminals 23 electrically. Under these conditions, on the other hand, after the slider release portion 210 has overridden the movable lock/stop arm 112, since the slider release portion 210 pushes the engage projection 342 of the first bendable arm 340 of the slider 300 inward, the first bendable arm 340 is deformed inward (downward in FIG. 5). At the same time, since the guide projection 208 of the slider release projection 206 of the female connector housing 200 is inserted between the two slider stoppers 150, the guide surface 208*a* of the guide projection 208 are brought into slidable contact with the guide slope surface 324 of the second bendable arm 320, so that the second bendable arm 340 is deformed outward (upward in FIG. 5). As a result, the engage projections 342 of the first bendable arm 340 are disengaged from the movable lock/stop arm 112 of the bendable lock arm 105, and further the collide walls 322 of the second bendable arm 320 are disengaged from the slider stoppers 150. In other words, the slider 300 is released from the male connector housing 100.

(4) As shown in FIGS. 6A and 6B, the slider 300 located at the half engagement position can be further inserted into the male connector housing 100 to the full engagement position. Under these conditions, the full engage portion 352 of the slider 300 is engaged with the movable full engage projection 114 of the bendable lock arm 105 of the male connector housing 100, so that the slider 300 can be locked with the male connector housing 100. When the slider 300 is inserted to the full engagement position, since the free ends of the two disconnect arms 310 of the slider 300 are brought into contact with the guide plates 412 formed at the free ends of the V-shaped contact pieces 410 of the short-circuit spring 400 and further inserted between the V-shaped contact pieces 410 of the short-circuit spring 400 and the female terminals 23, the elastic arms 404 of the short-circuit spring 400 are deformed inward, so that the V-shaped contact pieces 410 are disconnected from the female terminals 23 to release the short-circuit conditions of the two female terminals 23. Accordingly, it is possible to confirm the slider 300 can be engaged with the male connector housing 100 at the full engagement position securely by detecting the release of the short-circuit of the two female terminals.

Figure 7A:
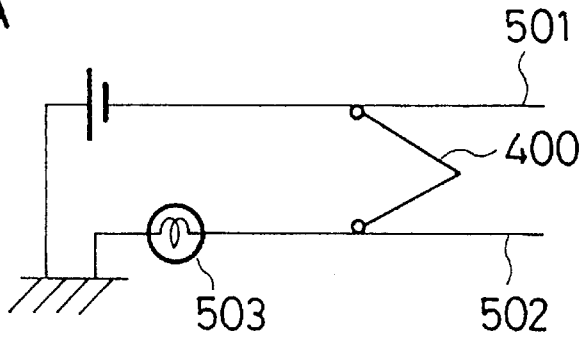
FIG. 7A is a circuit diagram showing the half engagement of the first embodiment of the present invention.
Figure 7B:
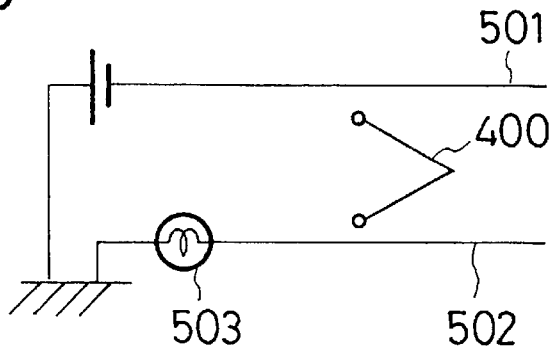
FIG. 7B is a circuit diagram showing the full engagement of the first embodiment of the present invention.
Figure 7C:
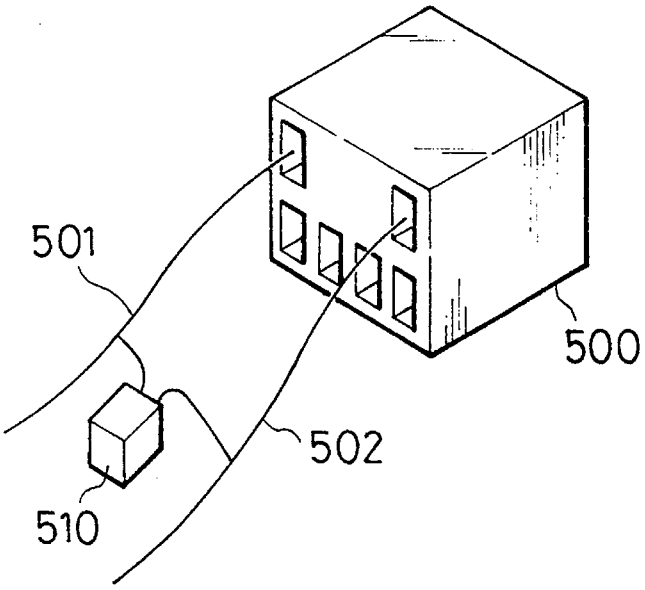
FIG. 7C is a view showing an engagement detector connected to the connector of the first embodiment.
Figure 8A:
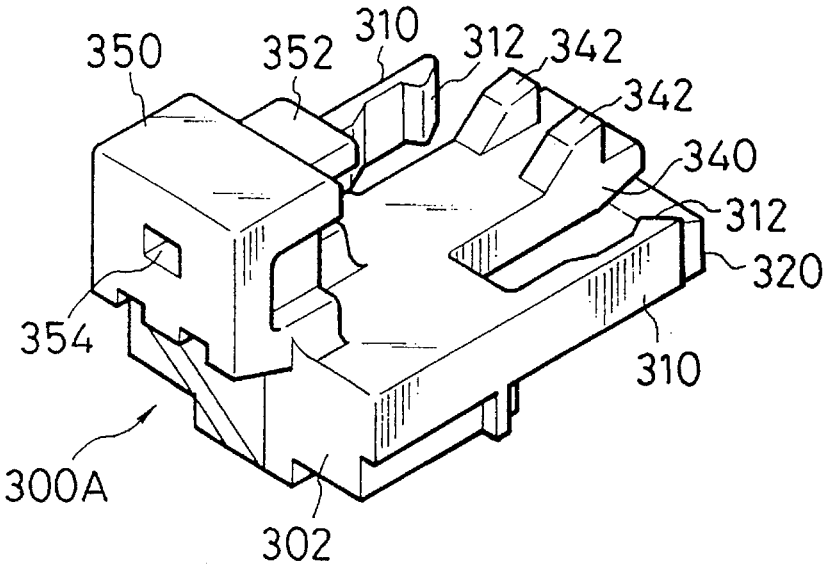
FIG. 8A is a perspective view showing the slider of a second embodiment of the present invention, obtained when seen from the rear side thereof.
Figure 8B:
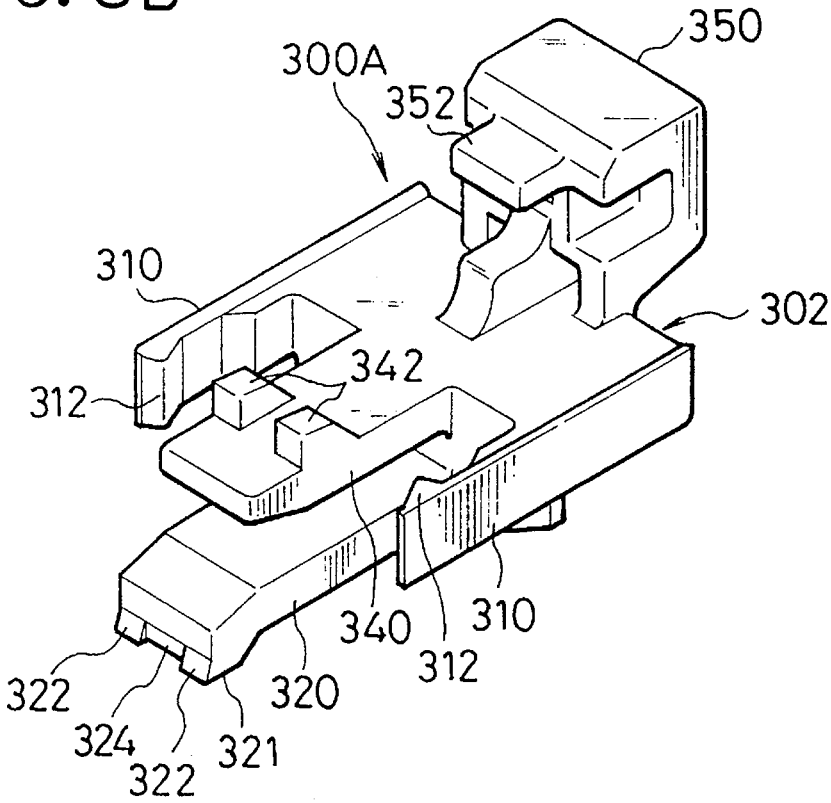
FIG. 8B is a perspective view showing the slider of a second embodiment of the present invention, obtained when seen from the front side thereof.

In more detail, FIG. 7A shows the status in which the slider 300 is located at the half engagement position, so that the short-circuit spring 400 shorts the two terminal wires 501 and 502. In FIG. 7A, the reference numeral 503 denotes a lamp for indicating the short of the two terminal wires 501 and 502. FIG. 7B shows the status in which the slider 300 is located at the full engagement position, so that the short-circuit spring 400 is disconnected from the two terminal wires 501 and 502. Further, FIG. 7C shows a detector 510 for checking whether a pair of the two terminal wires 501 and 502 are shorted in a connector housing 500 or not.

A second embodiment to the connector having an engagement detecting device according to the present invention will be described hereinbelow with reference to FIGS. 8A to 11.

In this second embodiment, only the slider 300A is different from that of the first embodiment in that a triangular cross-section engage (sloped surface) portion 312 is formed on an inner surface of the free end of each of the disconnect arms 310 of the slider 300. Therefore, the same reference numerals have been retained for the similar parts which have the same function as with the case of the first embodiment, without repeating the similar explanation thereof.

Figure 9:
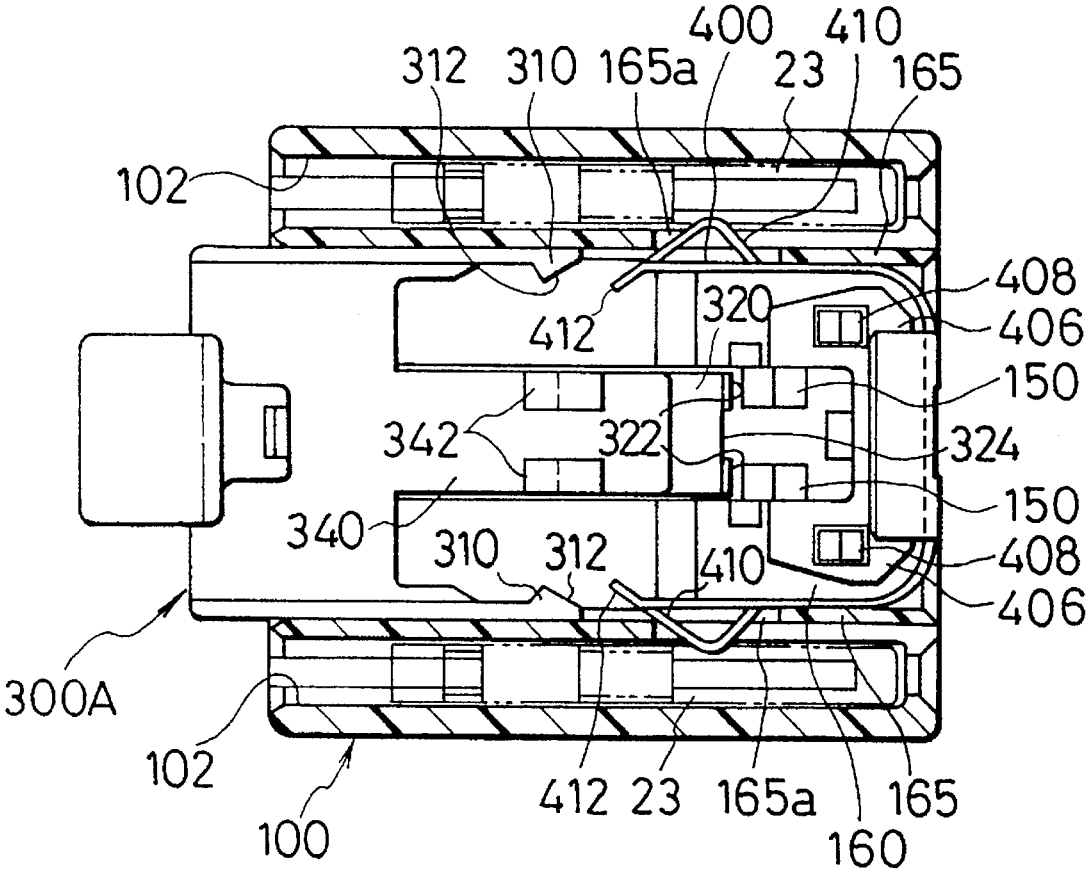
FIG. 9 is a transverse cross-sectional view showing the same connector of the second embodiment at a half engagement position.
Figure 10A:
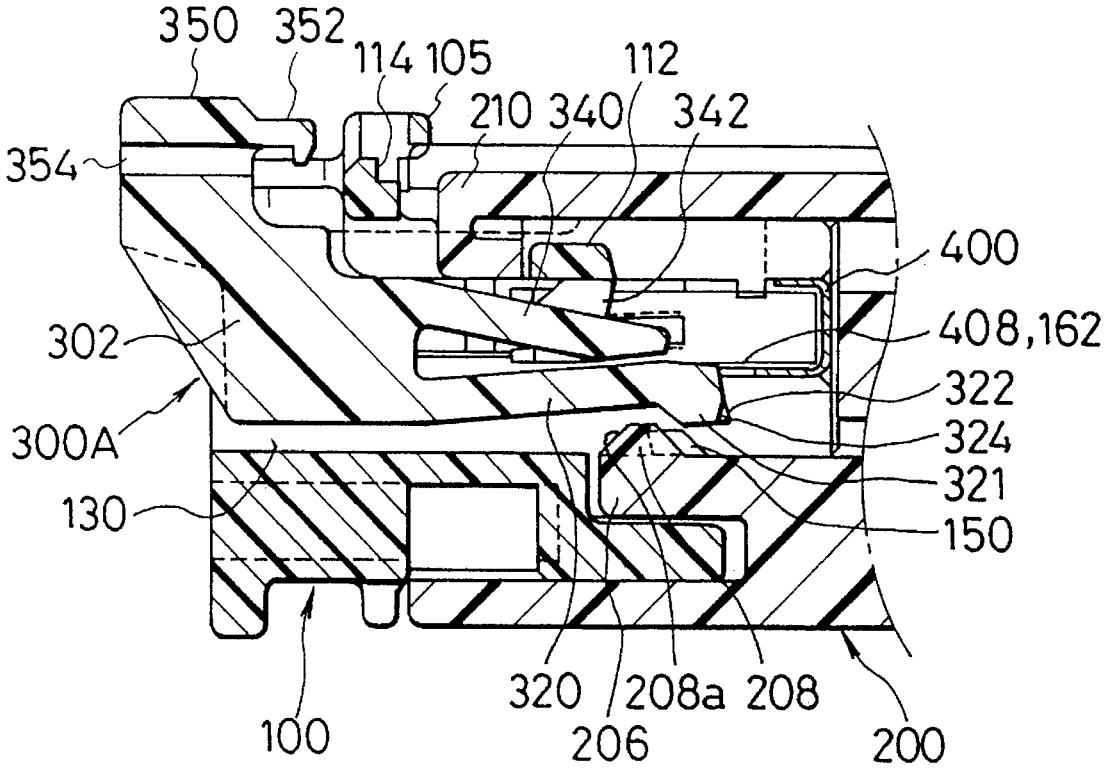
FIG. 10A is a longitudinal cross-sectional view showing the connector of the second embodiment, in which the slider is being inserted toward the full engagement position.
Figure 10B:
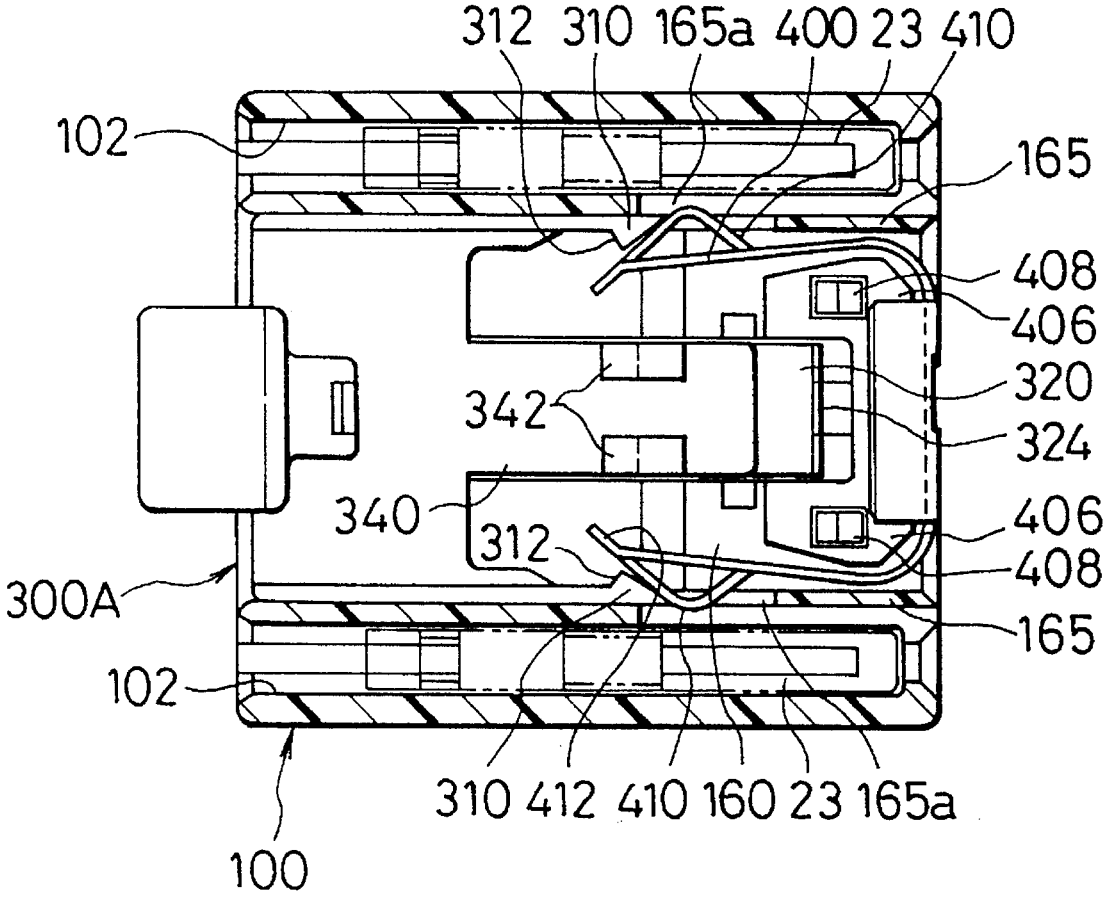
FIG. 10B is a transverse cross-sectional view showing the same connector of the second embodiment, in which the slider is being inserted toward the full engagement position.
Figure 11:
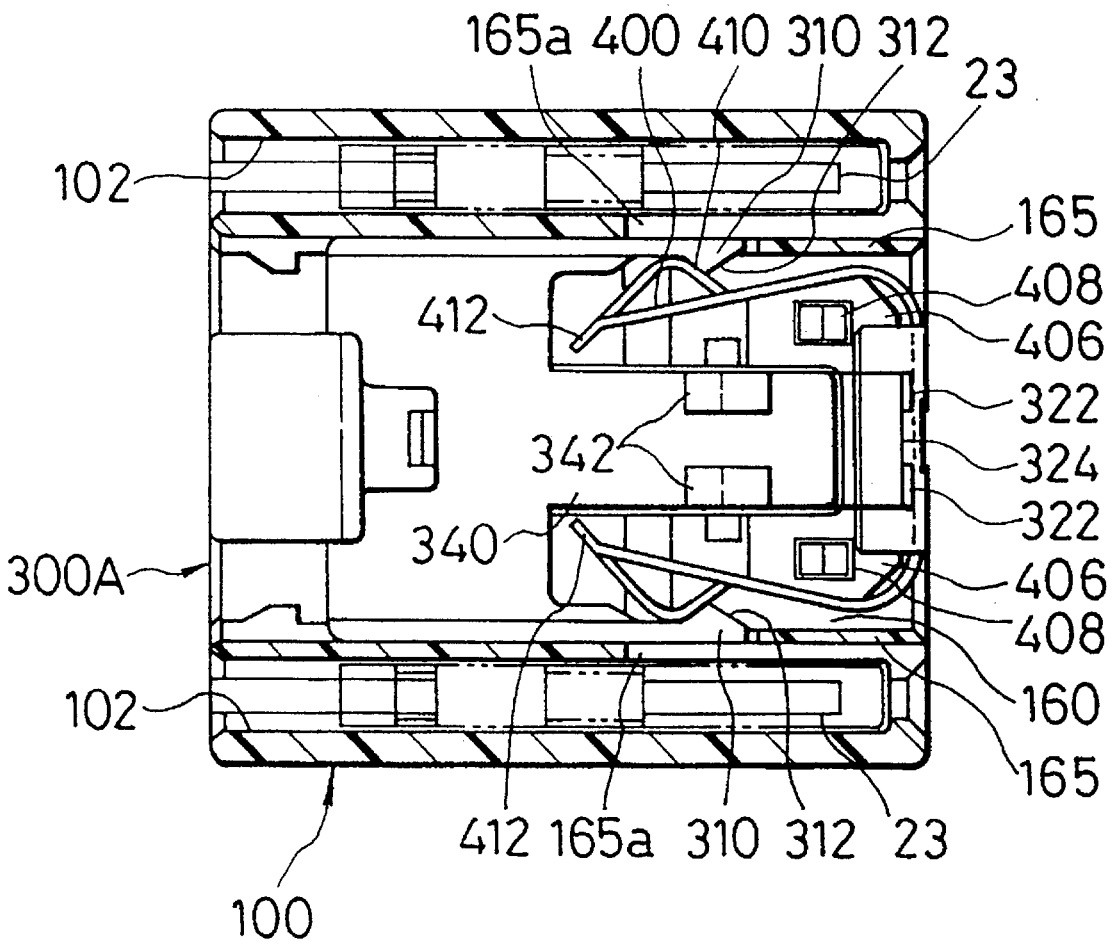
FIG. 11 is a transverse cross-sectional view showing the same connector of the second embodiment, in which the slider has been inserted to the full engagement position.

In this second embodiment, since the triangular engage portions 312 are additionally formed at the free ends of the disconnect arms 310, when the slider 300 is further inserted into the male connector housing 100 from the position shown in FIG. 9, the front end surfaces of the engage portions 312 are brought into surface contact with the end surfaces of the V-shaped contact pieces 410 of the short-circuit spring 400. In this case, since a reaction force can be applied more securely from the elastic arms 404 of the short-circuit spring 400 to the disconnect arms 310 of the slider 300 via the sloped contact surfaces of the V-shaped contract pieces 410 and the triangular cross section engage portions 312 in the rearward direction as shown in FIG. 10B, it is possible to return the slider 300 in more effective way as compared with the case of the first embodiment shown in FIG. 4B. In other words, as shown in FIG. 10B, when the slider 300A is inserted to the half engagement position, a large returning force can be applied to the slider 300A. Further, when the slider 300A is further inserted to the full engagement position as shown in FIG. 11, since the triangular cross section engage portions 312 override the V-shaped contract pieces 410, another opposite reaction force is applied to the slider 300A in the frontward direction (the rightward in FIG. 11), so that the slider 300A can be moved into the male connector housing 100 (toward the full engagement position) more securely and quickly. As a result, it is possible to provide a click feeling to the slider 300A. In addition, at the full engagement position, since the slider 300A is urged by the elastic force of the short-circuit spring 400 so as to be inserted into the male connector housing 100, it is possible to prevent the slider 300A from being stopped midway between the half and full engagement positions, so that the slider 300A can be held at the full engagement position more securely and thereby a more reliable electric detection can be realized.

Further, in the above-mentioned embodiments, although the slider 300 or 300A is formed with the first and second bendable arms 340and 320 and thereby movable lock/stop arm 112 and the slider stoppers 150 are both formed in the male connector housing 100, since the slider 300 or 300A can be stopped also by the short-circuit spring 400 as shown in FIG. 4B, it is possible to omit any one of the bendable arms 340 and 320 and the slider stoppers 150.

In the connector as described above, it is possible to check the imperfect engagement of the male and female connector housing electrically. Further, even if the slider 300 is not engaged full with the male connector housing 100, this can be also detected electrically. Further, when the slider 300 is full engaged with the male connector housing 100, since the two female terminals 23 are released for the short-circuit condition, it is unnecessary to prepare any other special detecting terminals. In other words, there exists such an advantage that it is possible to check the connector housing engagement condition and the slider position by use of the connector terminals, without preparing any other terminals. That is, when the slider 300 is located at the full engagement position in the male connector housing 100, since the two terminal wires 501 and 502 are not shorted as shown in FIG. 7C, the two terminal wires 501 and 502 connected to the connector as the connector wires can be used as they are to check the connector housing engagement, without connecting any other wires for checking the connector housing engagement.

Further, when the slider 300 is inserted to the full engagement position, since a reaction force is applied to the slider 300 by an elastic force of the V-shaped elastic arms 404 of the short-circuit spring 400 in such a direction that the slider 300 is returned to the half engagement position, it is possible to firmly lock the slider 300 with the male connector housing 100 by use of the full engage portion 352 of the slider 300 and the movable full engage projection 114 of the bendable lock arm 105, so that the slider 300 can be prevented from being moved inadvertently. Further, since the reaction force can be generated by the V-shaped elastic arms 404 of the short-circuit spring 400, a secure engagement feeling can be provided to the worker. That is, when the slider 300 is not engaged to the full engagement position, since the slider 300 is returned to the half engagement position, the worker can be easily know the imperfect engagement of the slider 300 with the male connector housing 100. In addition, since the reaction force can be generated by the V-shaped elastic arms 404 of the short-circuit spring 400, no additional return spring for the slider 300 is required, being different from the prior art connector.

Further, since the short-circuit spring 400 is formed into a U-shape and further disposed within the male connector housing 100 (without being attached to the slider), being different from the prior art connector, the short-circuit spring 400 can be disposed stably under well balanced conditions without being dislocated easily, so that the elastic arms 404 of the short-circuit spring 400 can be brought into contact with or away from the terminals under well balanced conditions.

Further, since the slider 300 is stopped at the half engagement position by the movable lock/stop arm 112 and the slider stoppers 150 of the male connector housing 100, the stopper 300 can be stopped at the half engagement position stably. Further, since the slider stoppers 150 and the second bendable arm 320 are both located within the male connector housing 100, no external force is applied to the second bendable arm 320, so that it is possible to prevent the slider 300 from being released from the half engagement and thereby moved inadvertently or erroneously from the half engagement position. In addition, when the male and female connector housings 100 and 200 are locked perfectly; that is, when the movable lock/stop arm 112 of the male connector housing 100 is locked with the slider release portion 210 of the female connector housing 200, since the slider 300 can be released from the half engagement position, it is possible to confirm both the half and full engagement conditions from the outside securely.

As described above, in the connector according to the present invention, since the half engagement of the male and female connector housings can be detected electrically, the connector assembly process can be automatized. Further, at the full engagement position, since the terminals are not shorted, it is possible to check the connector housing engagement conditions by use of the wires actually connected to the terminals (without additionally connecting any other detecting wires).

Further, since the short-circuit spring is disposed statically (without being moved together with the slider) within the male connector housing under well balanced condition, the short-circuit spring can be connected to or disconnected from the female connector terminals more stably, thus providing a more reliable connector housing engagement detection.

Further, when the slider is inserted to the full engagement position, since a reaction force is applied from the short-circuit spring to the slider, a secure feeling can be obtained and further the slider will not be stopped midway (because returned to the original position), so that it is possible to prevent the slider from being moved inadvertently in spite of the fact that no other spring is not used.

Further, since the sloped surface is formed at the free end of each of the disconnect arms of the slider, it is possible to apply a reaction force from the short-circuit spring to the slider more effectively and stably, and further a click feeling to the worker at the full engagement position.

What is claimed is:

1. An electrical connector having an engagement detecting device, comprising:

a first connector housing for housing a plurality of first connector terminals, wherein said first connector housing has a front opening and a rear opening;

a second connector housing for housing a plurality of second connector terminals mated with the first connector terminals, and engaged with said first connector housing;

a slider being inserted into said front opening and being positioned inside of said first connector housing in two stages of a half engagement position and a full engagement position; and a U-shaped short-circuit spring being inserted into said rear opening and being positioned inside of said first connector housing, for electrically shorting two corresponding connector terminals of said plurality of first connector terminals and second connector terminals when said slider is inserted into said first connector housing to the half engagement position, but electrically disconnecting said corresponding connector terminals when said second connector housing is engaged with said first connector housing and thereafter said slider is further inserted into said first connector housing from the half engagement position to the full engagement position.

2. An electrical connector having an engagement detecting device, comprising:

a first connector housing for housing a plurality of first connector terminals, wherein said connector housing has a front opening and a rear opening;

a second connector housing for housing a plurality of second connector terminals mated with the first connector terminals, and engaged with said first connector housing;

a slider being inserted into said front opening and being positioned inside of said first connector housing in two stages of a half engagement position and a full engagement position; and a short-circuit spring being inserted into said rear opening and being positioned inside of said first connector housing, for electrically shorting two corresponding connector terminals of said plurality of the first connector terminals and second connector terminals when said slider is inserted into said first connector housing to the half engagement position, but electrically disconnecting said corresponding connector terminals when said second connector housing is engaged with said first connector housing and thereafter said slider is further inserted into said first connector housing from the half engagement position to the full engagement position, wherein said short-circuit spring is formed into a U-shape having a pair of elastic arms, each of the elastic arms being formed with a V-shaped contact piece at each free end thereof so as to be connected to or disconnected from the mated connector terminals and to apply a reaction force from the V-shaped contact piece to said slider when said slider is being further inserted into said first connector housing from the half engagement position to the full engagement position.

3. The electrical connector having an engagement detecting device of claim 2, wherein said slider comprises at least one bendable arm which can be stopped by said first connector housing in the half engagement position, a pair of disconnect arms for electrically disconnecting the V-shaped contact pieces of said short-circuit spring from the mated connector terminals, and a full engage portion.

4. The electrical connector having an engagement detecting device of claim 3, wherein each of the disconnect arms is formed with a sloped surface at a free end thereof to apply the reaction force effectively from the V-shaped contact piece of said short-circuit spring to said slider, when said slider is further inserted into said first connector housing from the half engagement position to the full engagement position.

5. The electrical connector having an engagement detecting device of claim 3, wherein said first connector housing is formed with a movable locking and stopping arm and at least one slider stopper to stop said slider inserted into said first connector housing to the half engagement position.

6. The electrical connector having an engagement detecting device of claim 5, wherein said second connector housing is formed with a slider release portion for moving the movable locking and stopping arm and a slider release projection for moving the bendable arm of said slider, to allow said slider to move from the half engagement position to the full engagement position after said second connector housing is engaged with said first connector housing.

7. The electrical connector having an engagement detecting device of claim 3, wherein said first connector housing is formed with a movable full engage projection engaged with the full engage portion of said slider when said slider is inserted into said first connector housing to the full engagement position.

8. The electrical connector having an engagement detecting device of claim 3, wherein said first connector housing is formed with a pair of guide grooves for guiding a pair of the disconnect arms.

* * * * *